United States Patent [19]

Wellekens

[11] Patent Number: 4,490,998

[45] Date of Patent: Jan. 1, 1985

[54] TAMPER-RESISTANT LOCK ASSEMBLY

[76] Inventor: John Wellekens, 41 Crescent Ave., Staten Island, N.Y. 10301

[21] Appl. No.: 525,428

[22] Filed: Aug. 23, 1983

Related U.S. Application Data

[63] Continuation of Ser. No. 272,592, Jun. 11, 1981, abandoned.

[51] Int. Cl.[3] ..... E05B 13/04; E05B 17/18; E05B 19/08

[52] U.S. Cl. ..... 70/419; 70/401; 70/409; 70/427

[58] Field of Search ..... 70/419–421, 70/416, 423, 424, 427, 428, 455, 398, 401, 402, 405, 406, 409

[56] References Cited

U.S. PATENT DOCUMENTS

| | | | |
|---|---|---|---|
| 477,142 | 6/1892 | McKee | 70/409 |
| 758,025 | 4/1904 | Taylor | 70/421 |
| 1,702,430 | 2/1929 | Fremon | 70/419 |
| 3,313,134 | 4/1967 | Gahmberg | 70/419 |
| 3,512,382 | 5/1970 | Check et al. | 70/358 |
| 3,578,371 | 5/1971 | Keller | 70/419 X |
| 3,779,332 | 12/1973 | Snitgen | 70/455 X |
| 4,031,730 | 6/1977 | Kern | 70/423 X |
| 4,325,242 | 4/1982 | Tietz | 70/401 |

FOREIGN PATENT DOCUMENTS

| | | | |
|---|---|---|---|
| 593582 | 3/1960 | Canada | 70/423 |
| 1780397 | 12/1971 | Fed. Rep. of Germany | 70/455 |

*Primary Examiner*—Robert L. Wolfe
*Assistant Examiner*—Lloyd A. Gall
*Attorney, Agent, or Firm*—Collard, Roe & Galgano

[57] ABSTRACT

A tamper-resistant lock assembly includes a pair of cooperating keyway guard plates, each of which has a keyway formed therethrough. The guard plates are laterally displaceable relative to one another for movement between an open position, in which the keyways thereof are substantially aligned to allow for passage of at least a portion of a key shank therethrough, and a closed position, in which the keyway of one of the guard plates is at least partially blocked by the other of the guard plates. A uniquely-configured key is also disclosed for use in combination with such guard plates.

15 Claims, 15 Drawing Figures

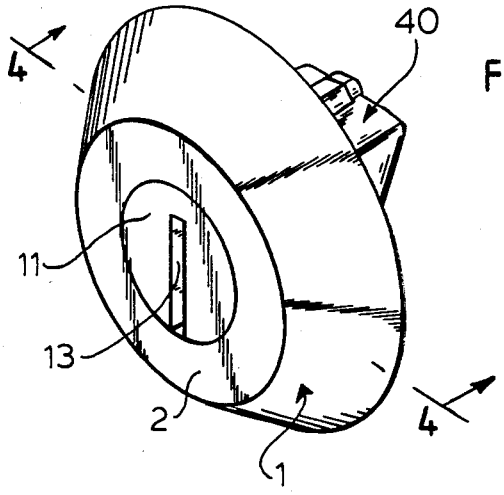
FIG.3
FIG.4
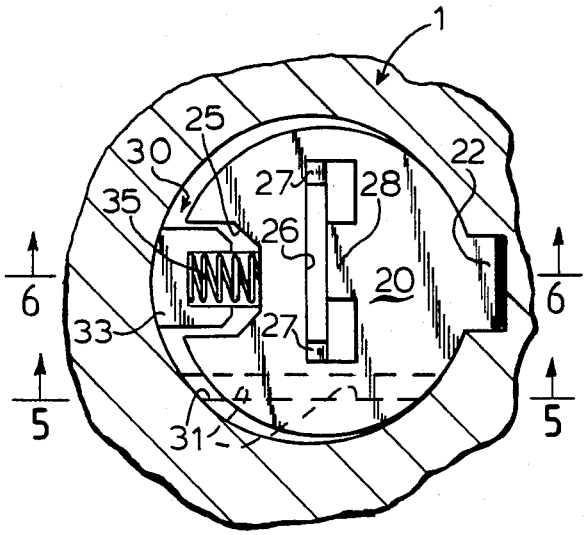
FIG.5
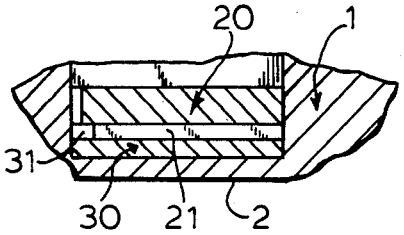
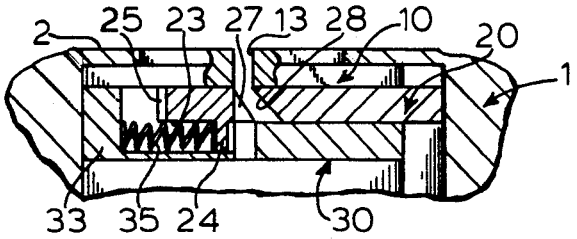
FIG.6

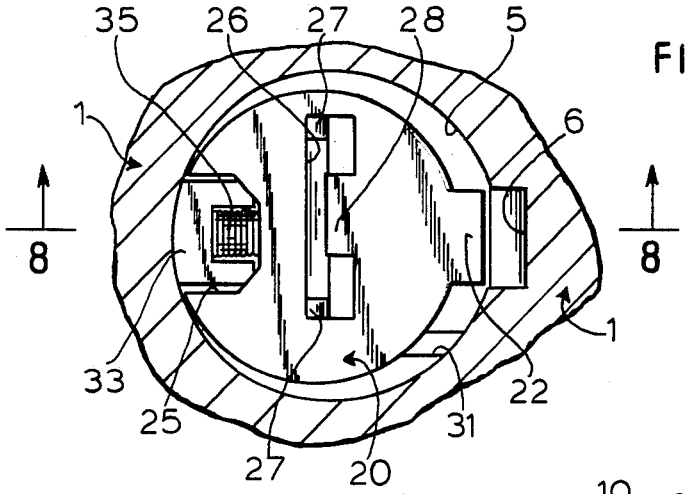
FIG.7
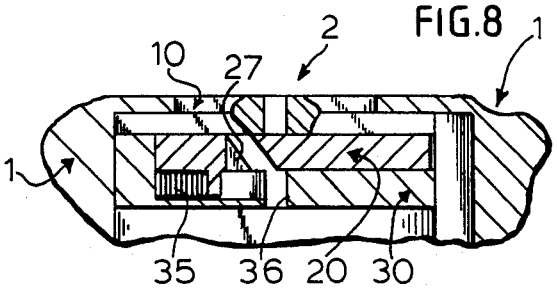
FIG.8
FIG.10b
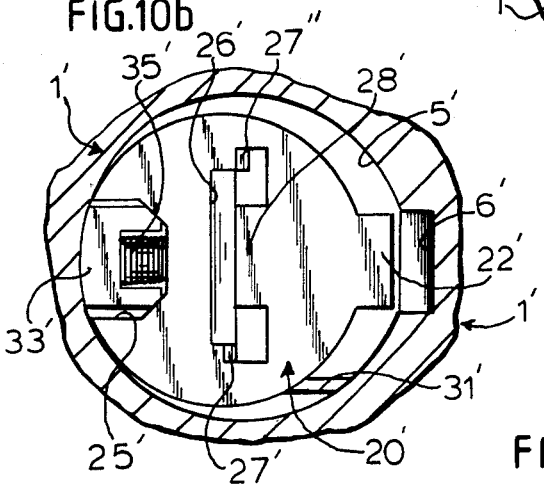
FIG.9
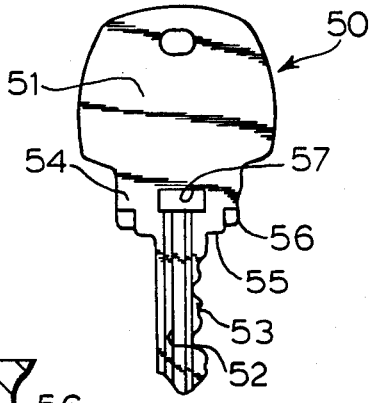
FIG.10a
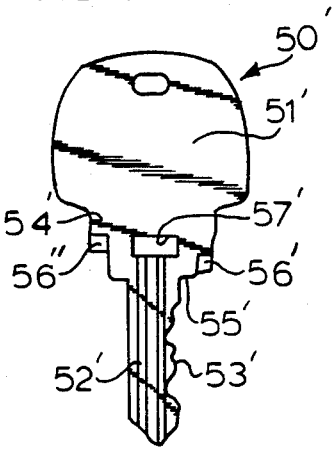
FIG.11
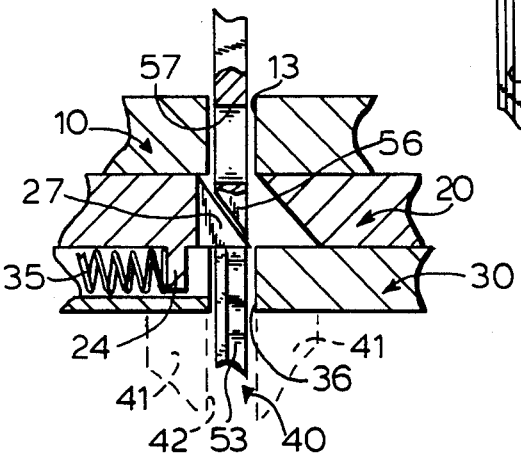

TAMPER-RESISTANT LOCK ASSEMBLY

This application is a continuation of Ser. No. 272,592, filed June 11, 1981, now abandoned.

This invention relates to a tamper-resistant lock assembly. More particularly, it relates to an improved tamper-resistant lock assembly which has a pin-type tumbler mechanism.

Locks of this type generally include a hollow cylinder housing or shell having a longitudinally-extending bore in which a lock cylinder or cylinder plug is rotatably mounted. The cylinder housing has a plurality of spaced-apart tumbler pin bores disposed normally to the lock cylinder bore, each having a spring-loaded tumbler pin mounted therein. The plug also has a plurality of spaced-apart tumbler pin bores disposed normally to the longitudinal axis thereof in which a second set of tumbler pins are provided which extend into the cylinder keyway and which are in axial alignment and abutment with the first set of pins.

In order to effect opening of the lock, it is necessary to align the abutting ends of the coacting pins at the so-called "cleavage" or "shear" line separating the cylinder housing and the lock cylinder. This will permit rotation of the lock cylinder within the cylinder housing, thus effecting opening of the lock. This is normally accomplished by means of a key which includes a shank or shaft having a key bit along one edge thereof which is receivable within the axial keyway defined between the cylinder and the cylinder housing and which, upon insertion, effects alignment of the pins at the shear line, thus permitting rotation of the central lock cylinder.

In order to prevent tampering with the lock, the pins in the cylindrical housing are usually provided with different lengths so that they will have to be pressed by different amounts to effect alignment of the pins relative to the shear line. As a result, the key bit is usually provided with a series of cuts, commonly referred to as a bitting, on the side edge thereof. The depths of the cuts of the bitting correspond to the different lengths of the pins, so that upon insertion of the key bit into the keyway, the pins will be depressed an appropriate amount so as to effect clearing of the shear line, thus permitting unlocking of the lock.

While locks of this type have been generally found to be satisfactory, they have not been found to be "tamper-proof" and unauthorized opening of these locks may be effected by pick tools. Moreover, so far as is known, no presently available lock assembly has been able to forestall use of pick tools with such a lock in a sufficiently simple and yet highly effective manner as herein proposed.

Accordingly, it is an object of the present invention to provide an improved novel lock assembly which greatly minimizes the possibility of tampering.

It is also an object of the invention to provide such a lock assembly which is of simple and economical construction, easy to use and install, and which is reliable in operation.

Certain of the foregoing and related objects are readily attained in a tamper-resistant lock assembly which includes a pair of cooperating keyway guard plates, each of which has a keyway formed therethrough. The guard plates are laterally displaceable relative to one another for movement between an open position in which the keyways thereof are substantially aligned to allow for passage of at least a portion of a key shank therethrough, and a closed position, in which the keyway of one of the guard plates is at least partially blocked by the other of the guard plates.

Preferably, the lock assembly additionally includes a cylinder guard having a front face, a rear face and a side face interconnecting the front and rear faces. A generally cylindrical main channel is formed therethrough extending from the front face to the rear face thereof and a cam-receiving slot is also formed therein which opens onto the main channel. Means are also provided for securing a cylinder lock having a keyway to the cylinder guard adjacent to the rear face thereof, such that the cylinder lock keyway is in general axial alignment with the main channel. The guard plates advantageously are generally circular and are rotatably received in the main channel of the cylinder guard.

Most desirably, the lock assembly also includes biasing means, such as a spring, interposed between the guard plates for normally maintaining the guard plates in the open position thereof. It is also advantageous that the other guard plate has at least one generally wedge-shaped opening cam projecting into the keyway thereof and, preferably, a pair of generally wedge-shaped opening cams projecting into the keyway from one side thereof disposed at opposite ends of the keyway; these cams may be laterally offset relative to one another.

In a preferred embodiment of the invention, the other of the guard plates has a keyway, the width of which is about at least double the width of the keyway of the one guard plate and a wedge-shaped latch cam projecting generally into the center of the keyway from the other side thereof. This latch cam is so positioned and dimensioned that it overlies and blocks the central portion of the keyway of the one guard plate when the guard plates are disposed on the closed position thereof.

It is also desirable that the other guard plate has a cam member projecting radially outwardly from the circumference thereof which is configured for releasable locking engagement with the cam-receiving slot of the cylinder guard when the guard plates are disposed in the open position thereof. It is further preferable that the assembly includes a lock cylinder having a rotatable cylinder plug with a keyway and wherein one guard plate is affixed to the rotatable cylinder plug for rotation therewith. It is also advantageous to provide a free-turning keyway cover plate having a keyway formed therein which is retained in the main channel of the cylinder guard adjacent to the front face thereof.

Certain of the foregoing and related objects are also attained by the provision of a key for the lock assembly which includes a key having a key head, a key shank provided with a key bit and an intermediate portion joining the key shank to the key head having at least one, and preferably two, cam faces configured and positioned for camming engagement with the cam or cams of the guard plate and a hole formed therethrough configured and dimensioned for receipt therein of the latch cam. The cam faces are longitudinally offset relative to one another when the opening cams of the guard plate are laterally offset.

Other objects and features of the present invention will become apparent from the following detailed description when taken in connection with the accompanying drawings which disclose several embodiments of the invention. It is to be understood that the drawings are designed for the purpose of illustration only and are not intended as a definition of the limits of the invention.

In the drawings, wherein similar reference characters denote similar elements throughout the several views:

FIG. 3 is a perspective view of the lock assembly in a fully assembled state;

FIG. 4 is a fragmentarily-illustrated transverse sectional view taken along line 4—4 of FIG. 3, showing the position of the latch plates prior to insertion of the key;

FIG. 5 is a fragmentarily-illustrated sectional view taken along line 5—5 of FIG. 4;

FIG. 6 is a fragmentarily-illustrated sectional view taken along line 6—6 of FIG. 4;

FIG. 7 is a fragmentarily-illustrated sectional view comparable to that of FIG. 4, but showing the position of the latch plates after the key is inserted (but with the key omitted for purposes of clarity);

FIG. 8 is a fragmentarily-illustrated sectional view taken along line 8—8 of FIG. 7;

FIG. 9 is a side elevational view of the lock assembly key;

FIG. 10*a* is a side elevational view of an alternate embodiment of the lock assembly key;

FIG. 10*b* is a fragmentarily-illustrated sectional view comparable to that of FIG. 7, but modified to accommodate the key of FIG. 10*a;*

Figure 12:
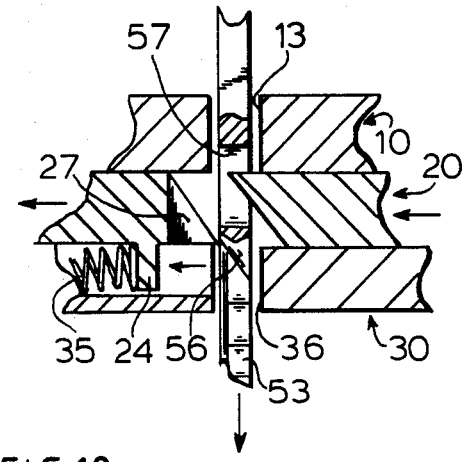
Figure 13:
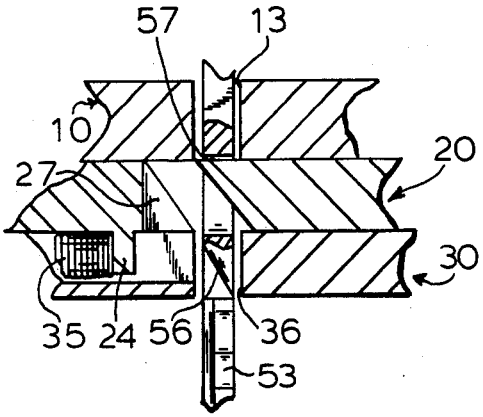
Figure 14:
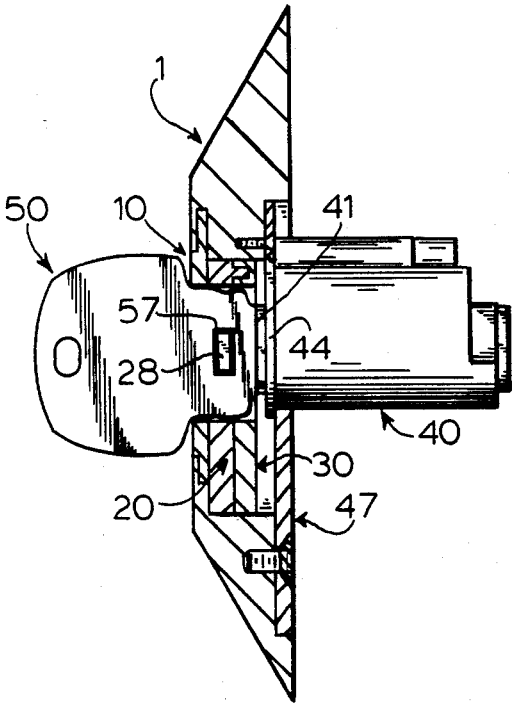

FIGS. 11, 12 and 13 show sequentially the insertion of the key into the lock to effect opening; and FIG. 14 is a sectional view, in part elevation, showing the key fully inserted in the lock.

Figures 1, 2:
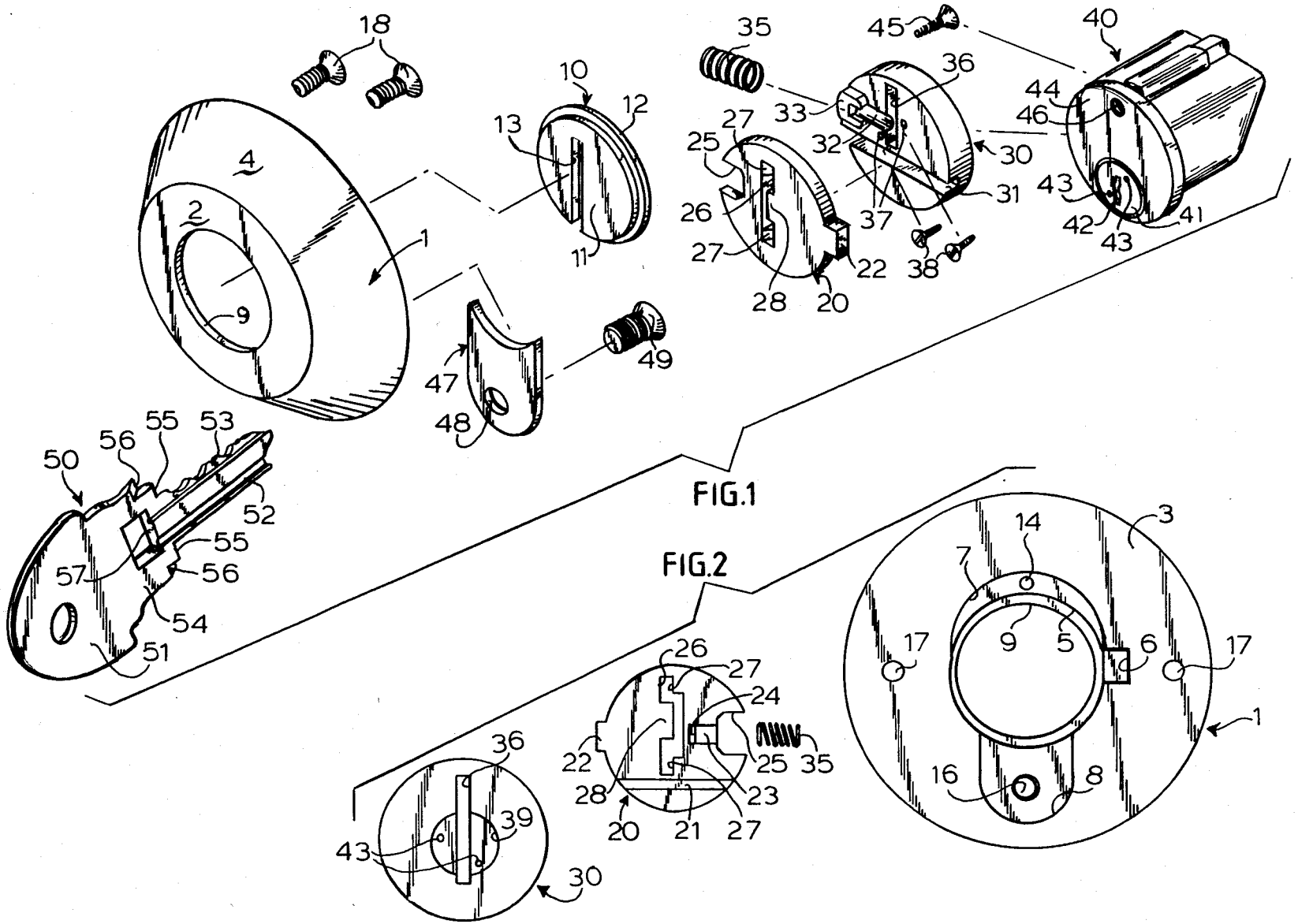
FIG. 1 is an exploded perspective view of a novel lock assembly, embodying the present invention.
FIG. 2 is an exploded rear elevational view of the cooperating latch plates and the cylinder guard of the lock assembly.

Turning now in detail to the appended drawings, therein illustrated is a novel lock assembly embodying the present invention which, as shown in FIG. 1, basically includes a cylinder guard 1, a free-turning keyway cover plate 10, a pair of cooperating keyway guard or latch plates 20 and 30, respectively, a conventional lock cylinder 40 and a key 50.

Cylinder guard 1 which is made of hardened steel has a generally frusto-conical profile and includes a generally annular front face 2, a rear face 3 (see FIG. 2) and a tapered sidewall 4. Cylinder guard 1 is further provided with a centrally-disposed cylindrical channel 5 extending from the front face 2 to the back face 3. Cylinder guard 1 is also provided with a generally right angle U-shaped, cam-receiving slot 6 which opens onto channel 5. Formed in rear face 3 of cylinder guard 1, there is also a recessed, quarter-moon shaped lock cylinder seating ledge 7 and, on the opposite side of channel 5, a recessed, generally U-shaped, lock cylinder retaining plate seating ledge 8. There is also a pair of screw holes 17 in rear face 3 for securing the cylinder guard via screws 18 to a suitable support (not shown).

The inner circumference of front face 2 projects radially inwardly into cylindrical channel 5 to define an annular lip 9 to allow for receipt thereon of circular keyway cover plate 10. Keyway cover plate 10 is provided with a circumferentially-extending step to define a front circular segment 11 having an outer diameter almost equal to the inner diameter of lip 9 so that the front surface thereof lies flush with front face 2 (see FIG. 3). It also has a circular rear segment 12 having a diameter which is almost equal to the outside diameter of lip 9 so that it abuts the same when inserted in channel 5, thereby preventing its removal through the front face of cylinder guard 1. Cover plate 10 is also provided with an elongated, generally rectangular keyway or slot 13.

Immediately behind keyway cover plate 10 is a pair of generally circular abutting, front and rear, keyway latch or guard plates 20 and 30, respectively. Latch plates 20 and 30 are slidably coupled together for lateral displaceable movement relative to one another; this may be accomplished, for example, by means of a tongue 21 and groove 31 connection (see FIGS. 1, 2 and 5). Front latch plate 20 is dimensioned and configured so that it may be mounted for free rotation in main channel 5 (see FIG. 7). However, it is further provided with a radially, outwardly-projecting, generally rectangular cam 22 which, upon lateral displacement of latch plate 20 within channel 5, may engage and project into cam-receiving slot 6 of cylinder guard 1 upon alignment therewith, so as to thereby prevent rotation of the same (see FIG. 4).

Front latch plate 20 and rear latch plate 30 are coupled together in a biased manner so as to place the same under tension and urge the plates laterally away from one another such that they normally assume the position shown in FIG. 4. This may be effected, e.g., by the provision of a spring 35 which is retained between the two plates 20 and 30 by means of cooperating grooves and end abutments provided in the abutting faces of plates 20 and 30. In particular, as seen best in FIGS. 2, 4 and 6, front plate 20 is provided with a generally semi-cylindrical groove 23 having a cylindrical disc-shaped end stop or abutment 24 at the inner end thereof and a generally U-shaped, notched portion 25 cut into the periphery of latch plate 20 at the opposite end thereof. Rear latch plate 30 is also provided with a complementary positioned and configured semi-cylindrical groove 32 and a raised generally U-shaped abutment 33 at the outer end thereof adjacent to the periphery of disc 30, which is configured and dimensioned for sliding receipt within the U-shaped notched portion 25 of plate 20 (see FIG. 4). Due to the fact that spring 35 will be positioned between the end abutments 24, 33 of the two plates 20, 30, it will urge the same laterally away from one another and thereby force cam 22 into cam-receiving slot 6 upon alignment therewith, as shown in FIG. 4. Conversely, upon compression of spring 35, the cam may be withdrawn from slot 6 (see FIG. 7) so as to thereby allow for rotation of latch plate 20.

Both of the latch plates 20 and 30 are also provided with aligned, elongated, generally rectangular keyways 26 and 36, respectively. Furthermore, rear latch plate 30 is provided with a pair of bore holes 37 on opposite sides of keyway 36 for securing the same by means of screws 38, to the slightly, outwardly-projecting face of rotatable cylindrical plug 41 of lock cylinder 40 via screw holes 43, such that keyway 36 is in alignment with keyway 42 of cylinder plug 41; the rear face of plate 30 also having a central recessed circular section 39 to accommodate the raised face of plug 41. In this way, latch plate 30 will rotate with cylinder plug 41.

Lock cylinder 40 is of conventional construction and it is provided with a circular front plate 44 which is configured for seating on the arcuate ledge 7 of cylinder guard 1. The same is also secured thereto via a screw 45, front plate bore 46 and a ledge screw hole 14. In addition, a retaining plate 47 which is received on seating ledge 8 and secured thereto via bore hole 48, an allen head screw 49 and ledge screw hole 16, is used to engage the rear edge of front plate 43 and the side of lock cylinder 40 (see FIG. 14), so as to rigidly secure the same to cylinder guard 1 and maintain proper axial alignment of the plug keyway 42.

Keyway 26 of latch plate 20 has a width which is approximately double the width of latch plate keyway 36, as can be seen in FIGS. 4, 7 and 8. At the top and bottom of the left half of keyway 26 are a pair of inwardly-projecting, downwardly-sloping, triangular or wedge-shaped cams 27 and on the right half of keyway 26 there is a centrally-disposed, inwardly-projecting, upwardly-sloped, wedge-shaped latch cam 28; the function and purpose of these cam elements will be discussed in greater detail hereinafter.

Finally, the assembly includes a uniquely-configured key 50 which, as shown in FIGS. 1 and 9, comprises a key head 51 at one end, a key shank 52 at the other end provided with a key bit 53 along the upper edge thereof, and an intermediate portion 54 joining key shank 52 and key head 51. Intermediate portion 54 has a pair of abutment faces 55 on opposite sides of key shank 53 which will abut the slightly raised face of rotatable plug 41 when key 50 is fully inserted into lock cylinder 40. Outwardly adjacent to these abutment faces 55 and offset rearwardly slightly therefrom are a pair of wedge-shaped cam elements 56 which are spaced and configured such that they will cam against the cam faces of cams 27 of latch plate 20 when key 50 is inserted into keyway 26 (see FIG. 11). Immediately behind cam elements 56 is a central cam-reception slot 57 which is configured to allow for passage and receipt of cam 28 therein.

Turning now in particular to the operation of the lock, as shown in FIG. 11, key 50 is inserted successively into keyways 13, 26, 36 and 42 until the cam elements 56 of key 50 engage the sloped faces of cams 27 of latch plate 20. Upon further insertion of key 50 (FIG. 12), the cams 56 will push cams 27 and latch plate 20 back against the force of spring 35 to allow for further key penetration. At the same time, as also shown in FIG. 12, lateral displacement of latch plate 20 against the force of spring 35 will cause the latching cam 28 of latch plate 20 to project between keyways 13 and 36 until it fully blocks the central portions thereof, as shown in FIG. 13. As can be appreciated, if the intermediate portion of the key were solid, this cam movement would prevent further penetration of the key. However, due to the provision of the central hole 57 in key 50, cam 28 may pass freely therethrough so as to allow for the full insertion of key 50 into the keyway 42 of lock cylinder 40 (see FIG. 14). At this point, cam 22 is withdrawn from cam slot 6 and therefore latch plate 20 is free to rotate. As a result, key 50, as well as latch plates 20, 30 and rotatable plug 41, may be rotated to open the lock. After the lock is opened, key 50 would be withdrawn in a reverse sequence relative to that shown in FIGS. 11–13, with the upwardly sloping faces of the cam elements allowing for easy and smooth removal thereof.

As can be appreciated, due to the provision of the central latch cam 28, it would be extremely difficult to use pick tools to pick the lock, as during rotation of the lock cylinder plug 41, cam 28 is disposed over the keyway thereby blocking the same to prevent tampering.

FIGS. 10*a* and 10*b* illustrate an alternate embodiment of the lock assembly. The components are essentially the same except for the key 50′ and the latch plate 20′. In particular, key 50′ is provided with a pair of longitudinally offset wedge-shaped cam elements 56′ and 56″, each having a forwardly-facing cam face, and latch plate 20° is provided with two laterally offset wedge-shaped cams 27′ and 27″ located in the left and right halves, respectively, of keyway 26′. As a result of this construction, when key 50′ is inserted in the lock keyway, a cam face of cam element 56′ will initially strike cam 27′, thereby causing partial lateral displacement of latch plate 20′ and simultaneously the movement of latching cam 28′ into the central hole 57′ of key 50′. At this point, cam element 56″ engages cam 27″ to complete the lateral movement of latch plate 20′. It should, of course, be realized that this offset arrangement facilitates easier opening as it allows a more gradual and smoother wedging apart and displacement of latch plate 20′.

It should also be apparent that other variations may be made as will be apparent to those skilled in the art. For example, although the slidable coupling of the latch plates together may be effected by a tongue and groove connection, it would also be possible to use, for example, a pin and slot connection. In addition, the configuration of the cylinder guard, the latch plates and cam, etc., may be modified to suit a particular application, so long as the functional interrelationships therebetween are not impaired.

Thus, while only several embodiments of the present invention have been shown and described, it will be obvious that many changes and modifications may be made thereunto, without departing from the spirit and scope of the invention.

What is claimed is:

1. A tamper-resistant lock assembly, comprising:

a pair of cooperating keyway guard plates, each of which has a keyway formed therethrough, said guard plates being laterally displaceable relative to one another for movement between an open position, in which said keyways thereof are substantially aligned to allow for passage of at least a portion of a key shank therethrough, and a closed position, in which the keyway of one of said guard plates is at least partially blocked by the other of said guard plates, and resilient biasing means interposed between said guard plates for normally maintaining said guard plates in said open position thereof.

2. The lock assembly according to claim 1, additionally including a cylinder guard having a front face, a rear face, a side face interconnecting said front and rear faces, a generally cylindrical main channel formed therethrough extending from said front face to said rear face thereof, a cam-receiving slot formed therein which opens onto said main channel and means for securing a cylinder lock having a keyway to said cylinder guard adjacent to said rear face thereof such that said cylinder lock keyway is in general axial alignment with said main channel, and wherein said guard plates are generally circular and are rotatably received in said main channel of said cylinder guard.

3. The lock assembly according to claim 2, wherein said other guard plate has a cam member projecting radially outwardly from the circumference thereof which is configured for releasable locking engagement with said cam-receiving slot of said cylinder guard when said guard plates are disposed in said open position.

4. The lock assembly according to claim 2, additionally including a free-turning keyway cover plate having a keyway formed therein and which is retained in said main channel of said cylinder guard adjacent to said front face thereof.

5. The lock assembly according to claim 1, wherein said other of said guard plates has at least one generally wedge-shaped opening cam projecting into said keyway thereof.

6. The lock assembly according to claim 5, wherein said other of said guard plates has a keyway, the width of which is about at least double the width of the keyway of said one guard plate and a wedge-shaped latch cam projecting generally into the center of said keyway from the other side thereof which is so positioned and dimensioned that it overlies and blocks the central portion of the keyway of said one guard plate when said guard plates are disposed in said closed position.

7. The lock assembly according to claim 6, additionally including a key having a key head, a key shank provided with a key bit and an intermediate portion joining said key shank to said key head having at least one cam face configured and positioned for camming engagement with said cam of said other guard plate and a hole formed therethrough configured and dimensioned for receipt therein of said latch cam.

8. The lock assembly according to claim 7, wherein said key has a pair of cam faces disposed adjacent to opposite lateral edges of said intermediate portion.

9. The lock assembly according to claim 8, wherein said cam faces are offset longitudinally relative to one another.

10. The lock assembly according to claim 1, wherein said other of said guard plates has a pair of generally wedge-shaped opening cams projecting into said keyway thereof from one side thereof, disposed at opposite ends of said keyway.

11. The lock assembly according to claim 10, wherein said opening cams are laterally offset relative to one another.

12. The lock assembly according to claim 1, additionally including a lock cylinder having a rotatable cylinder plug with a keyway and wherein said one guard plate is affixed to said rotatable cylinder plug for rotation therewith.

13. A tamper-resistant lock assembly and key therefor, comprising:

a lock assembly including a pair of cooperating keyway guard plates, each having a keyway formed therethrough, said guard plates being laterally displaceable relative to one another for movement between an open position, in which said keyways thereof are substantially aligned to allow for passage of at least a portion of a key shank therethrough, and a closed position, in which the keyway of one of said guard plates is at least partially blocked by the other of said guard plates, said other of said guard plates having at least one generally wedge-shaped opening cam projecting into said keyway thereof, and a wedge shaped latch cam projecting generally into the center of said keyway in said closed position, and resilient biasing means interposed between said guard plates for normally maintaining said guard plates in said open position thereof; and a key for use in said lock assembly including a key head, a key shank provided with a key bit, and an intermediate portion joining said key shank to said key head having a cam face configured and positioned for camming engagement with said at least one opening cam of said other of said guard plates and a hole formed centrally therethrough configured and dimensioned for receipt therein of said latch cam, said cam face cooperating with said at least one opening cam upon the insertion of said key into said keyway to move said other of said guard plates so that said latch cam engages within the hole in said intermediate portion of said key.

14. The lock assembly and key therefor as defined in claim 13, wherein said other of said guard plates has two generally wedge-shaped opening cams disposed at opposite lateral edges of said guard plate projecting into said keyway thereof and said key has a pair of cam faces disposed at opposite lateral edges of said intermediate portion for cooperation with said two opening cams of said guard plate.

15. The lock assembly and key therefor as defined in claim 14, wherein said opening cams of said other guard plate are offset longitudinally relative to one another.

* * * * *